US006259075B1

(12) United States Patent
Wu

(10) Patent No.: US 6,259,075 B1
(45) Date of Patent: Jul. 10, 2001

(54) CERAMIC-RESISTOR HEATING PLATE

(76) Inventor: Chia-Hsiung Wu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/474,267

(22) Filed: Dec. 29, 1999

(51) Int. Cl.[7] ..... H05B 3/06
(52) U.S. Cl. ..... 219/540; 392/347
(58) Field of Search ..... 219/540, 202, 219/504, 505; 392/347, 355, 360, 485

(56) References Cited

U.S. PATENT DOCUMENTS 4,414,052 * 11/1983 Habata et al. ..... 156/273.7
5,057,672 * 10/1991 Bohlender et al. ..... 219/540
5,192,853 * 3/1993 Yeh ..... 219/540
5,471,034 * 11/1995 Kawate et al. ..... 219/485
5,854,471 * 12/1998 Tadokoro et al. ..... 219/540
5,995,711 * 11/1999 Fukuoka et al. ..... 392/347

* cited by examiner

*Primary Examiner*—Tu Ba Hoang
(74) *Attorney, Agent, or Firm*—Dougherty & Troxell

(57) ABSTRACT

Disclosed is a ceramic-resistor heating plate for preventing corona discharge which is characterized in that an extruded insulating part is provided around the peripheral of the plate-shaped heating body. Therefore, the distance between the electrodes of the fin plates sandwiching the heating body can be increased and the problem of corona discharge can be prevented with reduced cost and enhanced safety.

6 Claims, 4 Drawing Sheets

CERAMIC-RESISTOR HEATING PLATE

BACKGROUND OF THE INVENTION

1. Field of the Invention

The present invention relates to a ceramic-resistor heating plate, more particularly, to a ceramic-resistor heating plate, which can prevent the problem of corona discharge.

2. Description of the Prior Art

The ceramic-resistor heating plate uses the infrared radiation to heat the object to be heated. Therefore, the ceramic-resistor heating plate is safer than the convention heater with real fire. However, since the ceramic-resistor heating plate is generally energized by electric power, the spark-induced problem, such as the burning of flock attached to the ceramic-resistor heating plate, is liable to occur. To prevent the above-mentioned problem, the distance between the electrodes of the ceramic-resistor heating plate is required to exceed 2.5 mm–3.0 mm to prevent the corona discharge and spark problem.

FIGS. 1, 2 and 3 show the structure of the conventional heating plate in an electric heater. The heating plate comprises a wave-shaped conductive fin plate 11, a ceramic-resistor heating body 12 sandwiched therebetween, lateral frame 13, and cover 14. The connector 15 protruded from the cover 14 conducts electric power to the heating body 1 through the fin plate 11. The front side and back side of the heating body 12 are coated with conductive film 121 and 122, respectively, for conducting the electric power from the connector 15. As shown in FIG. 3, the distance between the two electrodes (terminals) 110 of the heating body is required to be at least 3 mm to maintain the allowable voltage of the heating body. Therefore, the thickness of the heat body is increased. However, the material is wasted and the power consumption is increased. From the formula, $R=\rho \cdot L/A$, for a fixed value of resistivity $\rho$, the resistance R is proportional to the length L and inversely proportional to area A. The increase of heating body thickness will increase the resistance thereof. Therefore, to make a thinner heating body and maintain normal operation thereof within allowable voltage range is an important design issue.

SUMMARY OF THE INVENTION

It is an object of the present invention to provide a heating plate which has a protruded insulating region for affording an extended surface for the electrodes of the fin plate on both sides of the heating body, thus increasing the electrode distance and preventing the corona discharge.

It is another object of the present invention to provide a heating plate wherein the applied region of the conductive is of groove shape, thus increasing the electrode distance and facilitating the assembling operation.

It is still another object of the present invention to provide a heating plate having an insulating and heat-resistant frame enclosing the heating body thereof, thus increasing the electrode distance.

It is still another object of the present invention to provide a heating plate having an insulating and heat-resistant frame of I-shape cross-section, thus increasing the electrode distance.

It is still another object of the present invention to provide a heating plate wherein an insulating ribbon is wrapped around the heating body thereof, thus increasing the electrode distance.

The various objects and advantages of the present invention will be more readily understood from the following detailed description when read in conjunction with the appended drawing, in which:

Numeral

DETAILED DESCRIPTION OF THE PREFERRED EMBODIMENTS

Figure 1:
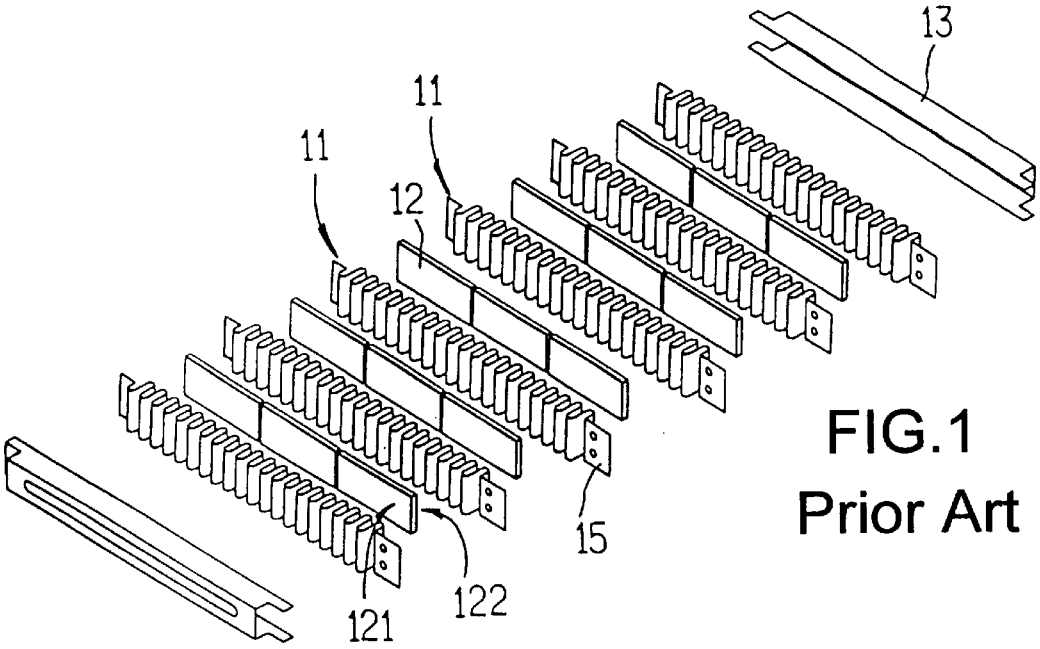
FIG.1 Prior Art
FIG. 1 is the exploded view of a conventional heating plate.
Figure 2:
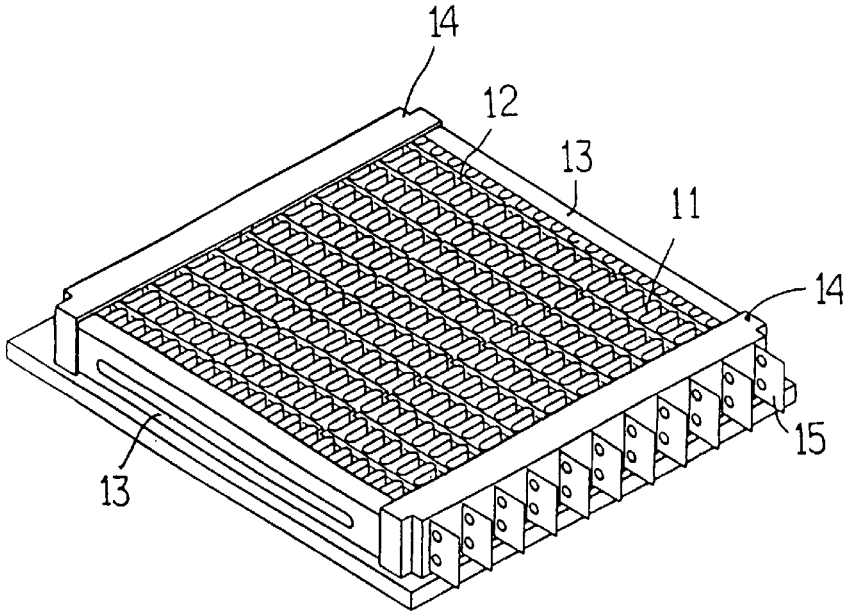
FIG.2 Prior Art
FIG. 2 is the perspective view of a conventional heating plate.
Figure 3:
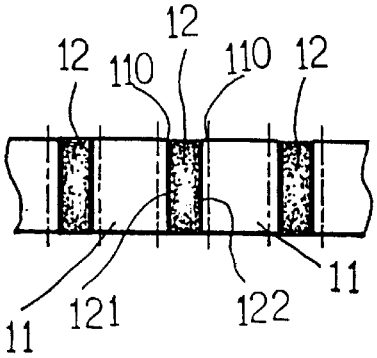
FIG.3 Prior Art
FIG. 3 is the cross-section view of the heating body in a conventional heating plate.
Figure 4:
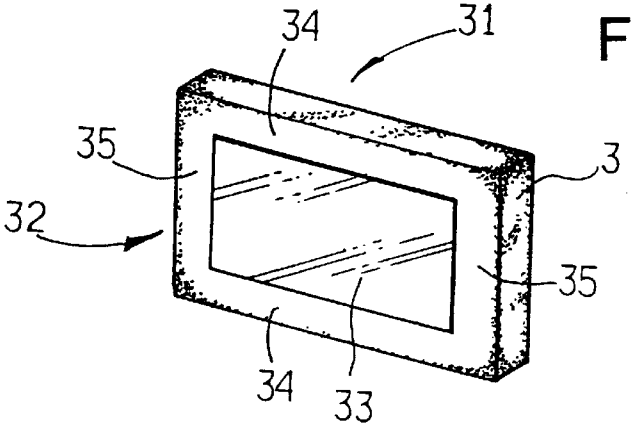
FIG. 4 is the schematic view of the heating body in a heating plate according to one embodiment of the present invention.
Figure 5:
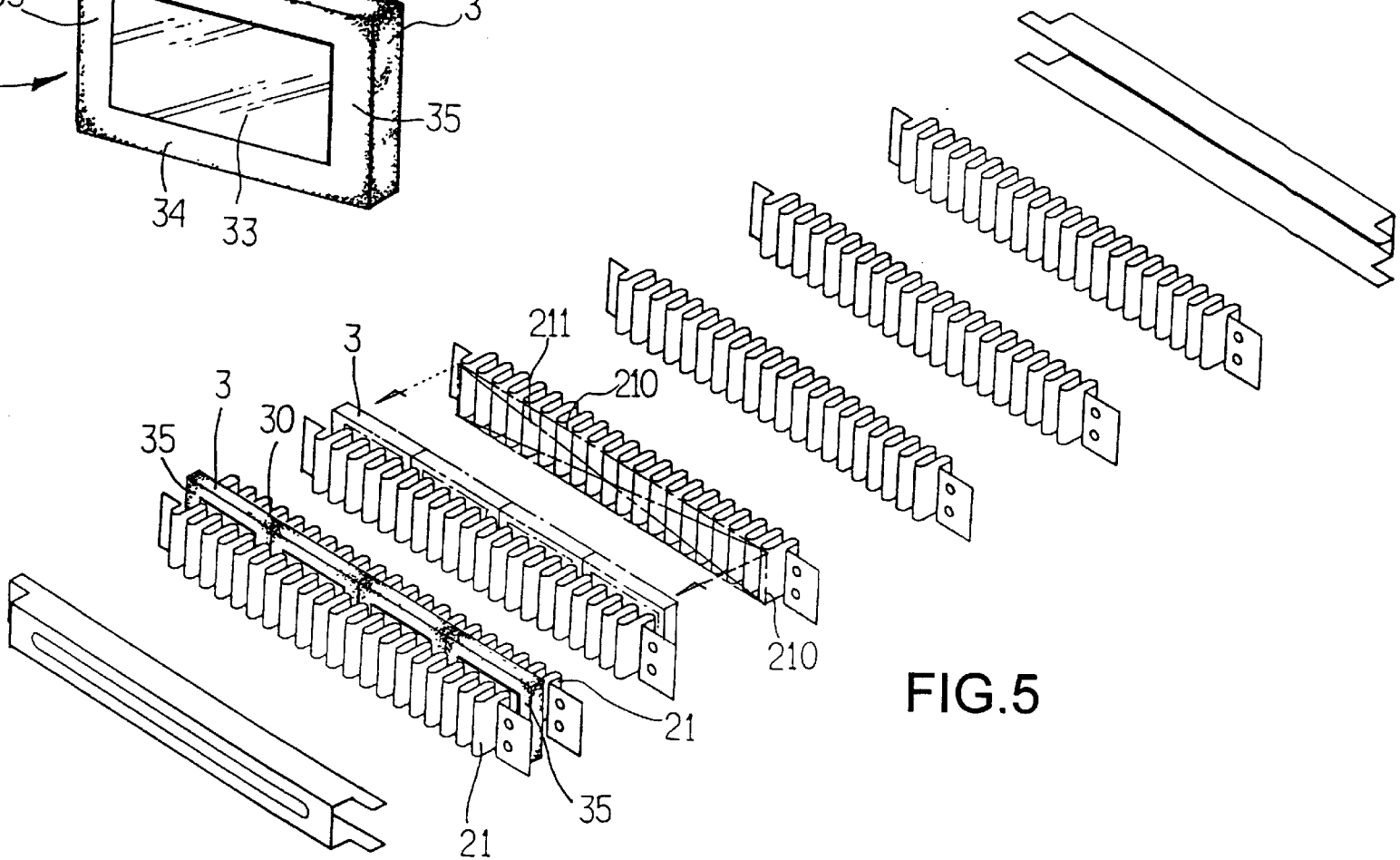
FIG. 5 is the exploded view of the heating plate according to one embodiment of the present invention.
Figure 6:
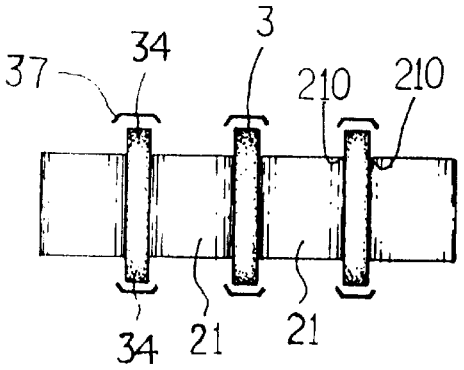
FIG. 6 is the partial cross-section view of the heating plate according to one embodiment of the present invention.

As shown in FIGS. 4 and 5, the ceramic-resistor heating body 3 of the inventive heating plate 2 is applied with conductive film 33 on the front side 31 and the back side 32 thereof. The heating body 3 receives electric power from the conductive fin plate 21 arranged on both sides thereof. As shown in FIG. 4, the conductive films 33 are such pasted that insulating part 34 is formed on the margin of the heating body 3, wherein the height of the conductive film 33 is preferably the same as the height of the fin plate 21. As shown in FIG. 5, the conductive plane 211 of the fin plate 21 is in contact with the conductive film 33 of each heating body to carry electric power. Each edge of the conductive plane 211 forms a conductive electrode (terminal) 210. As shown in FIG. 6, after arranging the above-mentioned component, the extruded insulating part 34 of the heating body 3 provides a larger distance for the electrodes 210. The distance between the electrodes 210 is preferably larger than 2.5 mm–3.0 mm to prevent the corona discharge.

With reference again to FIG. 5, the gap 30 is filled with insulating paste and the first/last heating body 3 in the same row is provided with insulating part 35 to further prevent the corona discharge.

Figure 7:
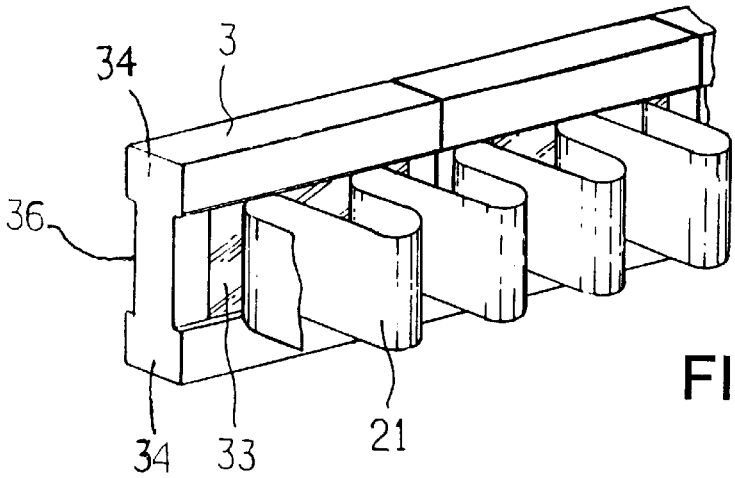
FIG. 7 shows another embodiment of the present invention.

As shown in FIG. 7, in another embodiment of the present invention, the heating body 3 has a groove 36 on the front/back side thereof and the height of the groove 36 is sufficient to accommodate the fin plate 21. Moreover, a conductive film 33 is applied on the bottom of each groove for providing the conduction path. Therefore, the electrode distance is increased and the fin plate 21 can be easily assembled.

Figure 8:
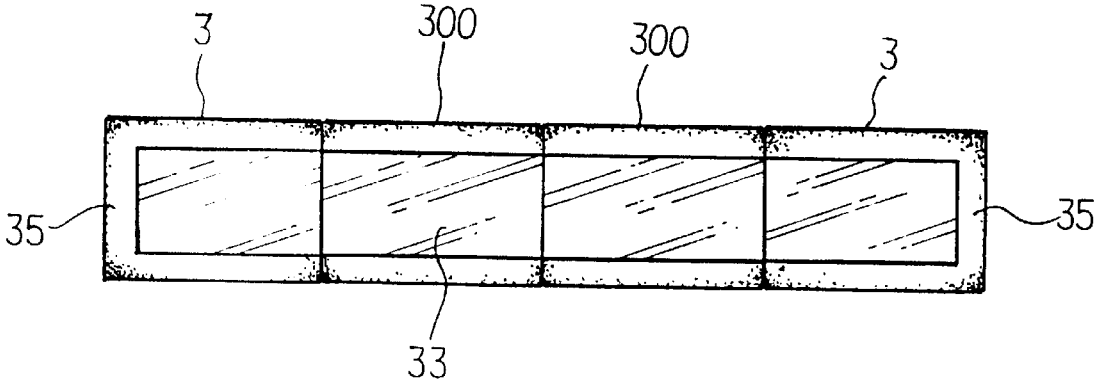
FIG. 8 shows another embodiment of the present invention.

As shown in FIG. 8, a plurality of heating bodies 3 along the same row are applied with conductive film throughout except the rightmost and leftmost heating bodies. In other words, the inner heating bodies 300 are applied with conductive film throughout in a transverse direction, the rightmost and leftmost heating bodies are provided with insulating part 35 and the gap 30 between two heating bodies 30 is applied with insulating paste for preventing the corona discharge.

With reference again to FIG. 6, to protect the extruded insulating part 34, a protective cap 37 is used to cover the insulating part 34 or a protective cap 37 is suspended to protect the insulating part 34.

Figure 9:
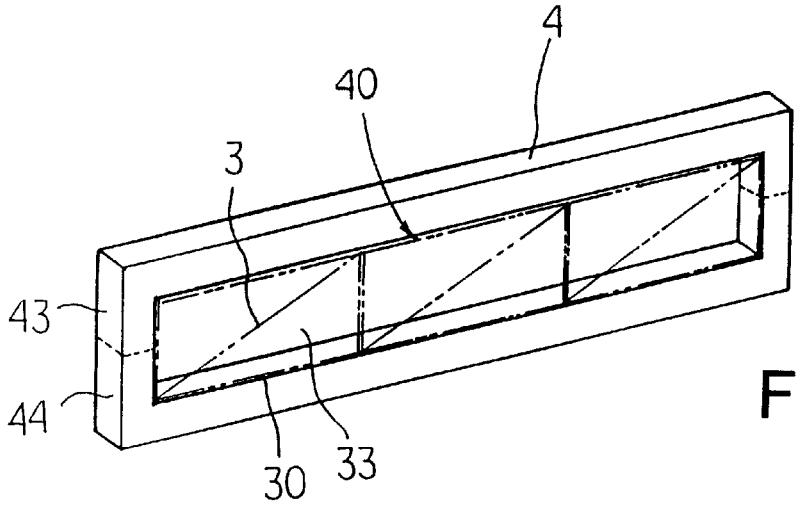
FIG. 9 shows still another embodiment of the present invention.

With reference now to FIG. 9, a hollow frame 4 with an upper frame 43, a lower frame 44 and an opening 40 is used to enclose the heating body 3. The heating body 3 is embedded into the opening 40 and the gap 30 is filled with insulating paste. The thickness of the insulating frame is preferably the same as that of the heating body. The opening 40 should be larger enough to accommodate the fin plate (not shown) if the thickness of the insulating frame is larger than that of the heating body 3. By the arrangement of the frame 4, the electrode distance is increased.

Figure 10:
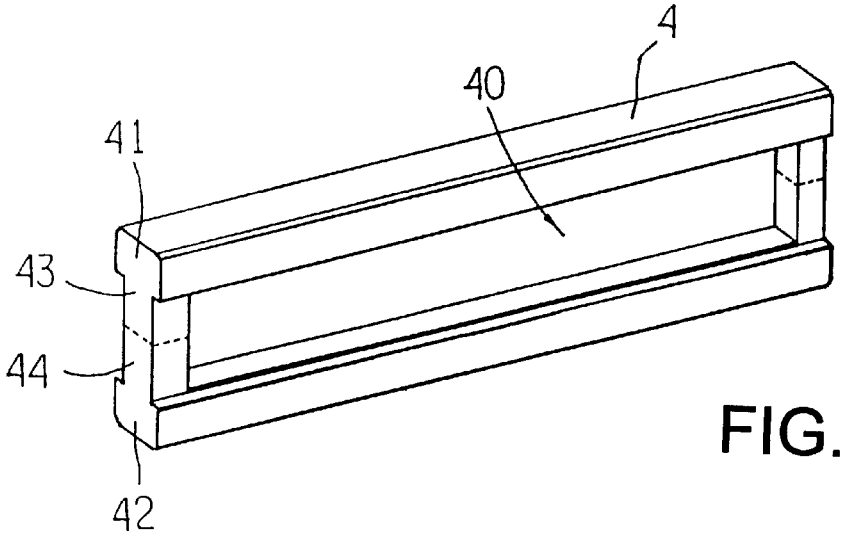
FIG. 10 shows still another embodiment of the present invention.

As shown in FIG. 10, the cross-section of the frame is of I-shape with bumps 41 and 42 on top end and bottom end, respectively. The frame 4 has an opening for the embedding of the heating body 3. By using the bumps 41 and 42, the electrode distance is increased.

As shown in FIGS. 9 and 10, the frame 4 can be formed by assembling the upper frame 43 and the lower frame 44, and has an opening formed therein.

Figure 11:
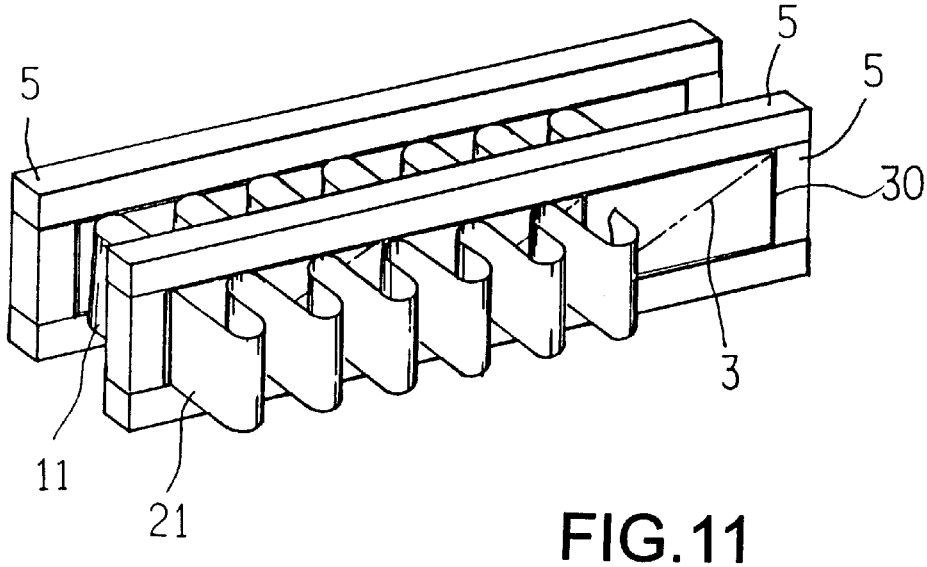
FIG. 11 shows still another embodiment of the present invention.

As shown in FIG. 11, a strip-shaped, insulating and heat-resistant ribbon 5 is wrapped around the heating body 3 and between two fin plates 11 and 21, thus increasing the electrode distance.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A ceramic resistor heating plate comprising:

a) at least one ceramic resistor heating body having front and back sides with conductive film on both front and back sides;

b) a protruding insulating region protruding outwardly from both the front and back sides, the region extending along at least two opposite margins bounding the conductive films; and, c) a plurality of elongated, serpentine conductive fin plates, each having a height less than a corresponding dimension of the at least one ceramic resistor heating body and equal to a distance between the opposite margins of the conductive films bounded by the protruding insulating regions such that, one serpentine conductive film plate contacts the conductive film on each of the front and back sides of the ceramic resistor heating body.

2. The ceramic resistor heating plate of claim 1 comprising a plurality of ceramic resistor heating bodies arranged in a row such that the front and back surfaces are aligned.

3. The ceramic resistor heating plate of claim 2 wherein gaps between adjacent ceramic resistor heating bodies are filled with insulating paste.

4. The ceramic resistor heating plate of claim 1 wherein the protruding insulating regions are formed integrally with the at least one ceramic resistor heating body and the at least one ceramic resistor heating body has an I-shaped cross-sectional configuration.

5. The ceramic resistor heating plate of claim 1 further comprising a protection cap covering the protruding insulating regions.

6. The ceramic resistor heating plate of claim 1 wherein the protruding insulating region comprises upper and lower frames on the at least one ceramic resistor heating body, the upper and lower frames bounding openings to expose the conductive films.

* * * * *